US008104615B2

(12) United States Patent
Liu

(10) Patent No.: US 8,104,615 B2
(45) Date of Patent: Jan. 31, 2012

(54) TOOL POSITIONING PAD

(76) Inventor: Wen-Chin Liu, Taiping (TW)

( * ) Notice: Subject to any disclaimer, the term of this patent is extended or adjusted under 35 U.S.C. 154(b) by 34 days.

(21) Appl. No.: 12/832,227

(22) Filed: Jul. 8, 2010

(65) Prior Publication Data

US 2010/0276436 A1 Nov. 4, 2010

Related U.S. Application Data

(63) Continuation-in-part of application No. 12/219,557, filed on Jul. 24, 2008, now abandoned.

(51) Int. Cl.

| | |
|---|---|
| ***B65D 85/20*** | (2006.01) |
| ***B65D 73/00*** | (2006.01) |
| ***B65D 81/02*** | (2006.01) |
| ***B65D 1/36*** | (2006.01) |

(52) U.S. Cl. ..... 206/373; 206/486; 206/523; 206/564

(58) Field of Classification Search ..... 206/372–373, 206/376–379, 443, 486–490, 523, 562–565
See application file for complete search history.

(56) References Cited

U.S. PATENT DOCUMENTS

| | | | |
|---|---|---|---|
| 3,224,569 | A | 12/1965 | Leitzel |
| 3,315,689 | A | 4/1967 | Melik |
| 4,158,408 | A | 6/1979 | Thiessen |
| 4,964,514 | A | 10/1990 | Wycech |
| 5,080,225 | A | 1/1992 | Russo et al. |
| 5,320,223 | A | 6/1994 | Allen |
| 5,511,662 | A | 4/1996 | Amoroso et al. |
| 5,526,928 | A | 6/1996 | Yabe et al. |
| 6,068,121 | A | 5/2000 | McGlinch |
| 6,920,978 | B2 | 7/2005 | Fischer et al. |
| 7,128,208 | B2 | 10/2006 | Hull |

*Primary Examiner* — Bryon Gehman
(74) *Attorney, Agent, or Firm* — Posz Law Group, PLC

(57) ABSTRACT

A tool positioning pad has a body, at least one positioning slot and two containing recesses. The body is a plastic foam block and corresponds to and is normally mounted in a tool box. The at least one positioning slot is formed in the body and each position slot has two ends and at least one non-straight section. Each non-straight section may be arced or curved and is integrally formed longitudinally in the positioning slot and has a convex inner sidewall. When a thin tool such as a spanner is placed into a positioning slot, the convex inner sidewall is deformed to press and securely hold the spanner inside the positioning slot.

12 Claims, 10 Drawing Sheets

TOOL POSITIONING PAD

The present invention is a continuation-in-part of application Ser. No. 12/219,557, filed on Jul. 24, 2008 now abandoned.

BACKGROUND OF THE INVENTION

1. Field of Invention

The present invention relates to a tool positioning pad, and more particularly to a tool positioning pad that is capable of accepting tools being positioned and placed inside a tool box.

2. Description of the Related Art

A conventional positioning pad is placed inside a tool box and has multiple slots formed therein. The slots may comprise straight slots, circular slots, specific-shaped slots or the like that are used for holding different kinds of tools inside and preventing these tools easily escaping from the slots. For instance, a straight slot is always used for mounting a spanner, a ruler or a saw inside, the circular slots are used for holding sleeves for a socket wrench and the specific-shaped slot may have a shape corresponding to a socket wrench. To present a tool escaping form the corresponding slot, a dimension of the slot has to be well designed corresponding to the tool. However, the specific tool still easily drops from the corresponding slot after frequently used.

Furthermore, for containing different tools with variety thickness, different dimensions of the slots are needed. However, forming these slots needs a variety of processing tools, and this increases costs of manufacturing and is troublesome for manufacturers.

The present invention provides a tool positioning pad to obviate or mitigate the shortcomings of the conventional positioning pad.

SUMMARY OF THE INVENTION

The primary objective of the present invention is to provide a tool positioning pad to solve escaping problems of a conventional one and reduce costs of manufacturing the positioning pad.

The tool positioning pad has a body, at least one positioning slot and two containing recesses. The body is a plastic foam block and corresponds to and is normally mounted in a tool box. The at least one positioning slot is formed in the body and each position slot has two ends and at least one non-straight section. Each non-straight section may be an arced, curved or bent section of the position slot and is integrally formed longitudinally in the positioning slot and has a convex inner sidewall. When a thin tool such as a spanner is placed into a positioning slot, the convex inner sidewall is deformed to press and securely hold the spanner inside the positioning slot.

Other objectives, advantages and novel features of the invention will become more apparent from the following detailed description when taken in conjunction with the accompanying drawings.

DETAILED DESCRIPTION OF THE INVENTION

Figure 1:
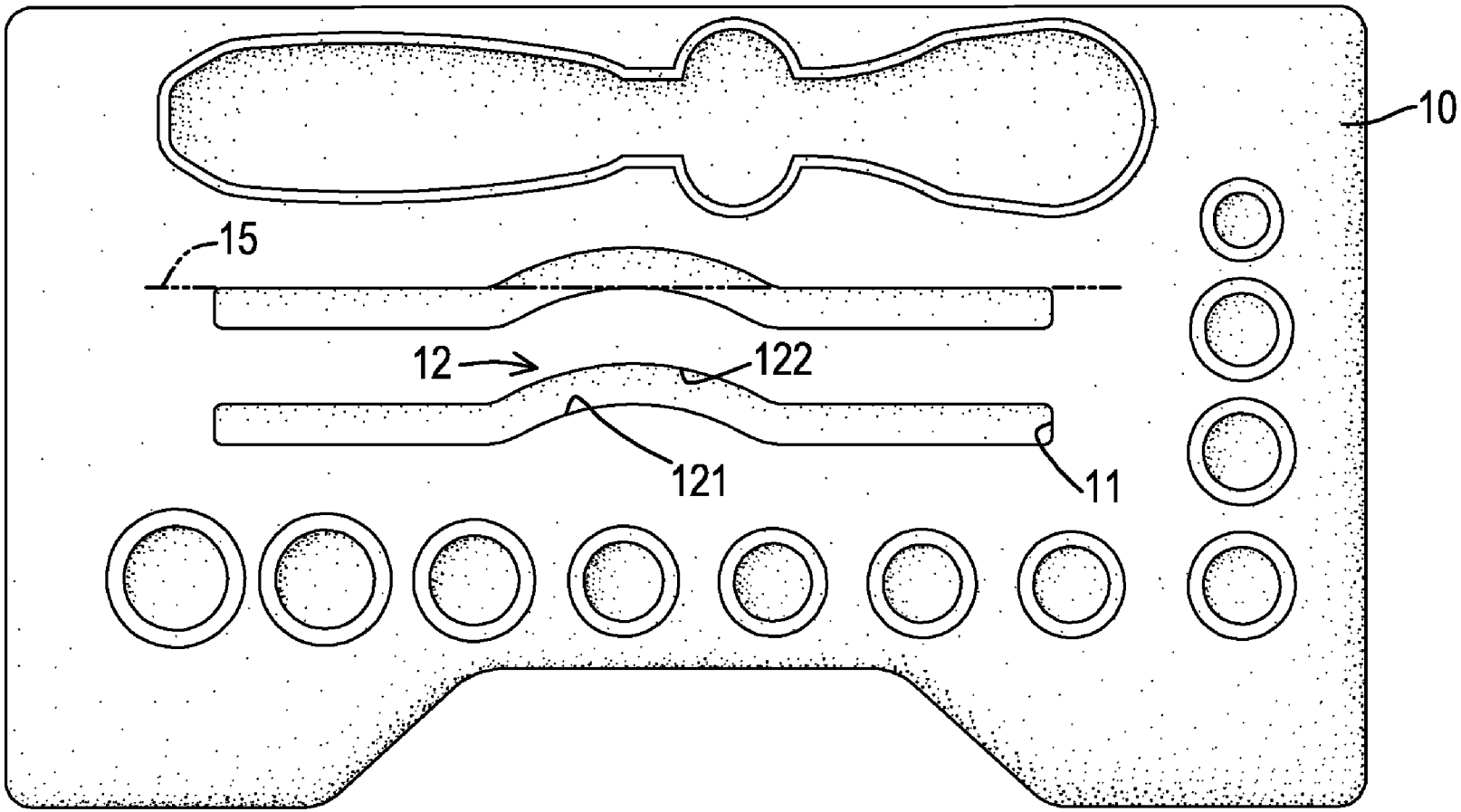
FIG. 1 is a top view of a tool positioning pad in accordance with the present invention.
Figure 2:
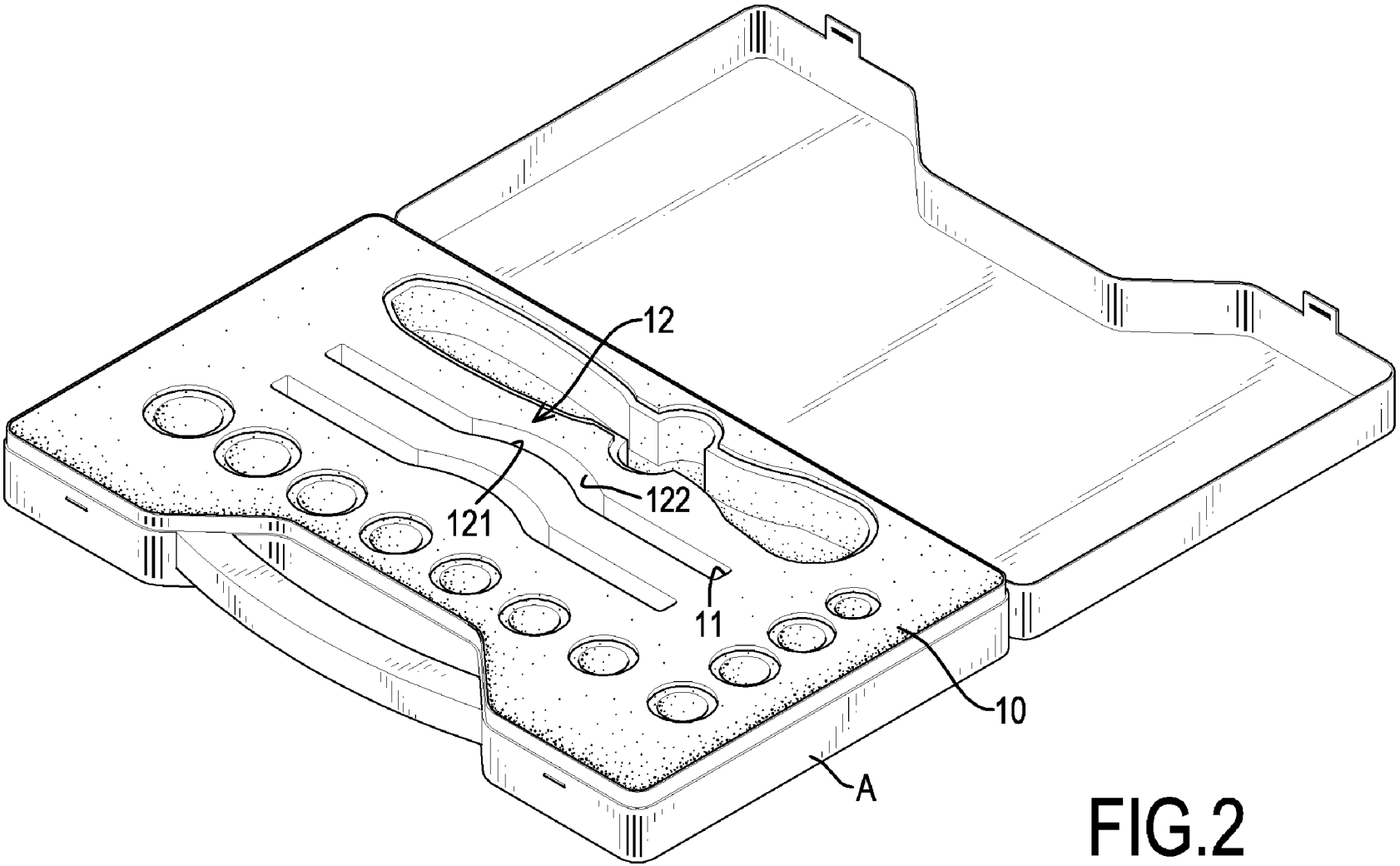
FIG. 2 is an operational perspective view of the tool positioning pad in FIG. 1, placed inside a tool box.
Figure 3:
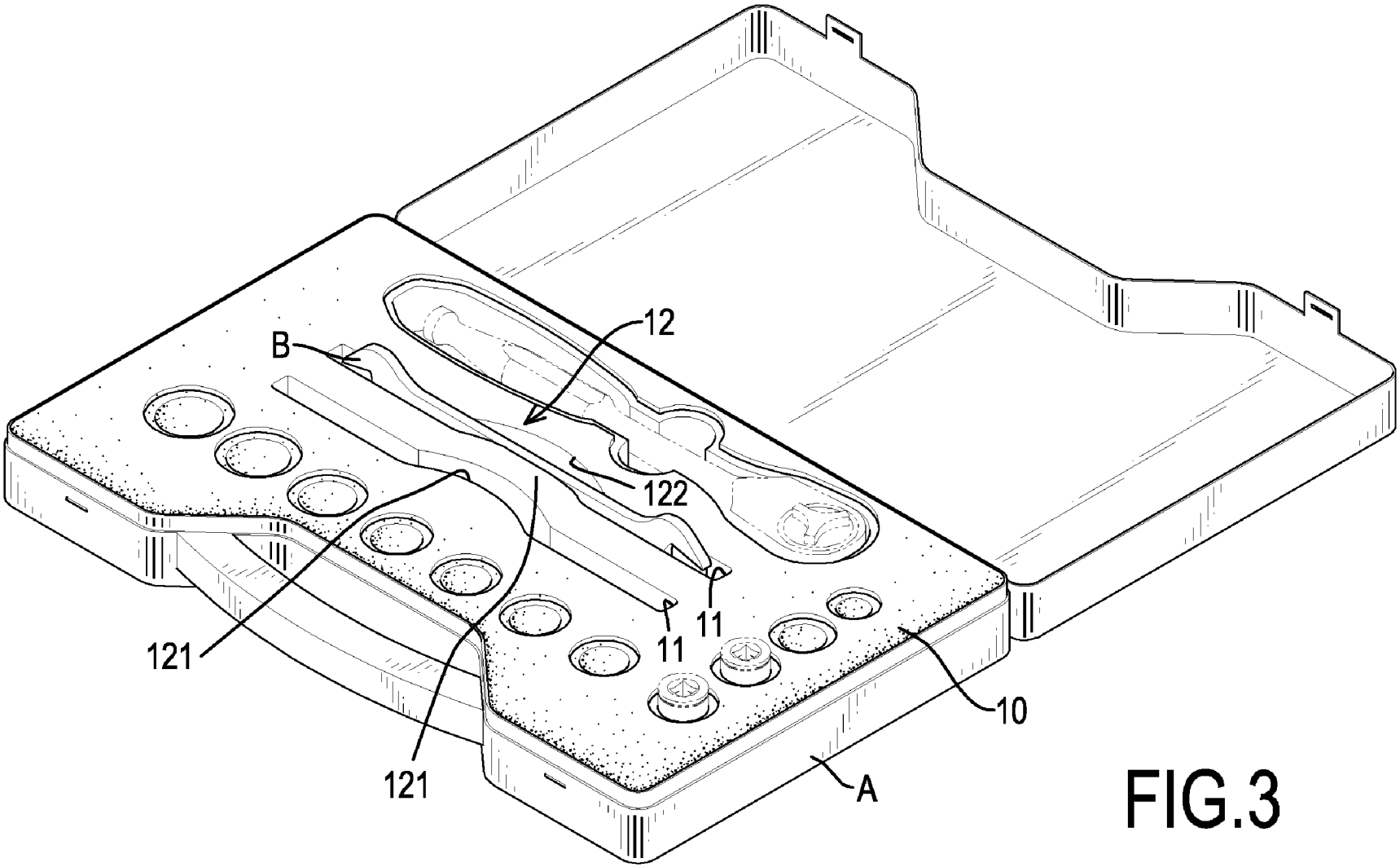
FIG. 3 is an operational perspective view of a positioning slot of the tool positioning pad in accordance with FIG. 2 holding tools inside.
Figure 4:
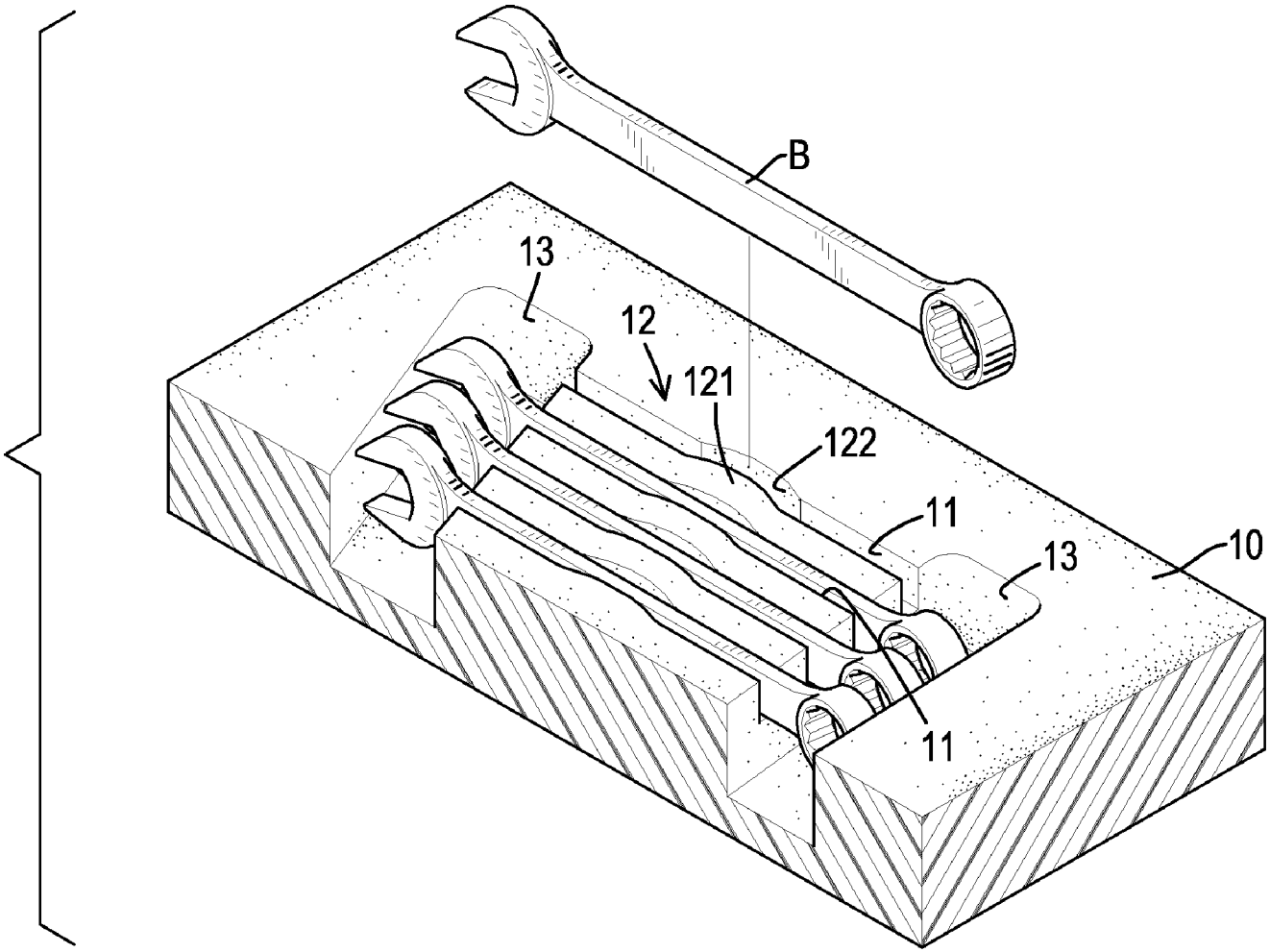
FIG. 4 is an operational perspective view in partial section of a tool positioning pad having parallelly multiple positioning slots and two containing recesses in accordance with the present invention.

With reference to FIGS. 1, 5, 7 and 10, a tool positioning pad in accordance with the present invention comprises a body (10) and at least one positioning slot (11, 11A, 11B, 11C) and may have two containing recesses (13).

The body (10) is a plastic foam block and corresponds to and is normally placed inside a tool box (A) and has two long sides and two short sides.

The at least one positioning slot (11, 11A, 11B, 11C) is formed in the body (10) and each positioning slot (11, 11A, 11B, 11C) has two ends and at least one non-straight section (12, 12A, 12B, 12C). Each positioning slot (11, 11A, 11B, 11C) may be a straight slot (11), an arced slot (11A), a wavy slot (11B), a zigzag slot (11C) or the like.

Each non-straight section (12, 12A, 12B, 12C) is integrally interconnected longitudinally in the positioning slot (11, 11A, 11B, 11C), has a convex inner sidewall (121, 121A, 121B, 121C) and a concave inner sidewall (122, 122A, 122B, 122C).

The convex inner sidewall (121, 121A, 121B, 121C) has at least one clamping point and a tangent line (15). The at least one clamping point is defined on the highs of the convex inner sidewall (121, 121A, 121B, 121C) to press against a tool. The tangent line (15) is linked with the at least one clamping point of the convex inner sidewall (121, 121A, 121B, 121C), is passed through the ends of the positioning slot (11, 11A, 11B, 11C) and parallel with the long sides of the body (10) as shown in FIGS. 1, 5, 7 and 10.

The concave inner sidewall (122, 122A, 122B, 122C) corresponds to and may be parallel with the convex inner sidewall (121, 121A, 121B, 121C). Hence, even though a flat tool with very thin thickness is placed inside the positioning slot (11, 11A, 11B, 11C), the convex inner sidewall (121, 121A, 121B, 121C) may press the flat tool to abut against the other parts of the positioning slot (11, 11A, 11B, 11C) and securely hold the tool in the positioning slot (11, 11A, 11B, 11C).

With reference to FIGS. 4, 5, 6 and 11, the containing recesses (13) are respectively formed in the body (10) and are respectively communicated with the ends of the at least one positioning slot (11, 11A, 11B, 11C). The tangent line (15) of the convex inner sidewall (121, 121A, 121B, 121C) is passed through the containing recesses (13). When the tool positioning pad comprises multiple positioning slots (11, 11A, 11B, 11C) those are separately and parallelly formed in the body (10), the two ends of each positioning slot (11, 11A, 11B, 11C) are respectively grouped on two sides of the body (10). The containing recesses (13) communicates with one end of each positioning slot (11, 11A, 11B, 11C) that is formed on the same side of the body (10). Therefore, a person may easily take up a flat tool (e.g. a spanner (B)) from the corresponding containing recess (13) to increase ease of use.

In a preferred embodiment in accordance with the present invention shown in FIGS. 1 to 4, the tool positioning pad has multiple positioning slots (11) being parallelly formed in the body (10). One non-straight section (12) is centrally interconnected with each positioning slot (11) and the convex inner sidewall of the non-straight section (12) is overlapped over the corresponding tangent line (15). Therefore, spanners (B) with different thickness may be securely mounted in the positioning slots (11) because the convex inner sidewall (121) are slightly deformed when the spanner (B) being mounted therein. Especially for the spanner (B) has a thickness thinner than the positioning slot (11), the spanner (B) may also be securely mounted inside the positioning slot (11) with the pressing force provided by the convex inner sidewall (121).

Figure 5:
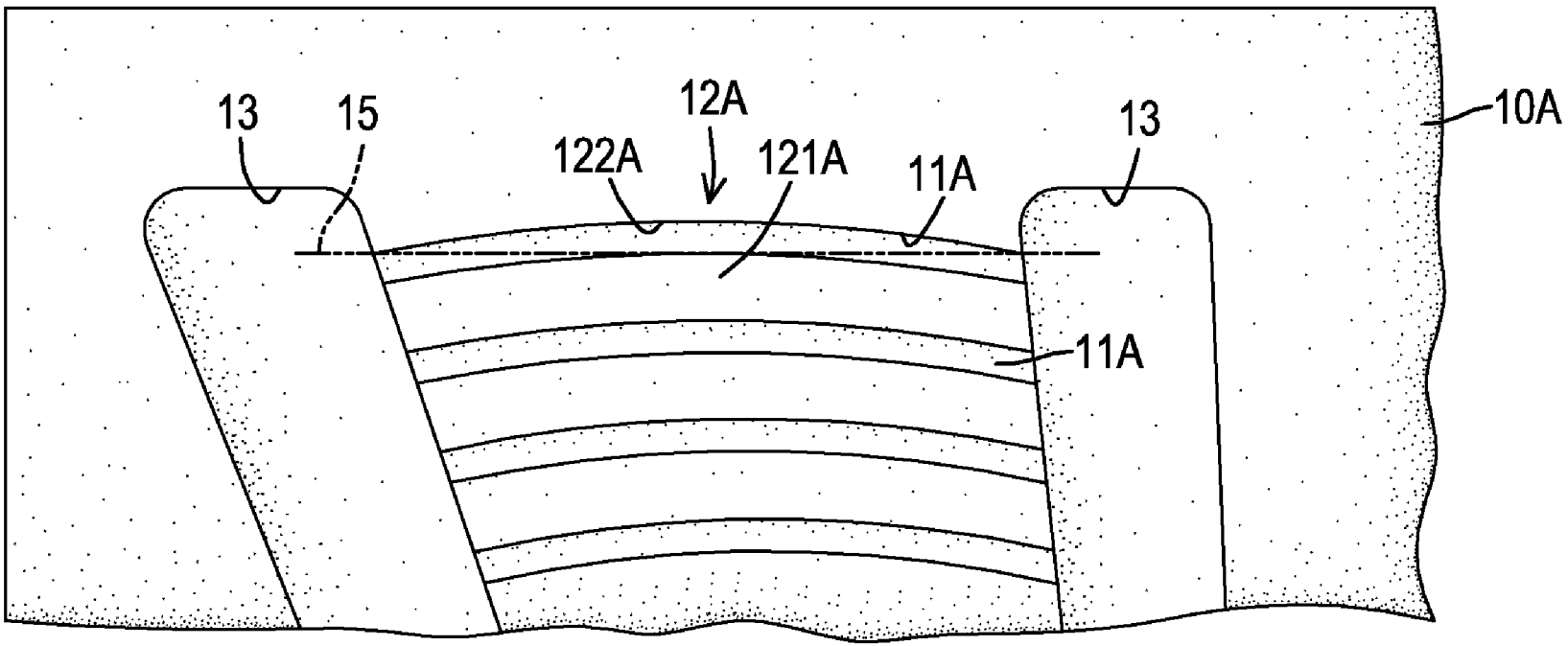
FIG. 5 is a top view of a tool positioning pad comprising multiple arced positioning slots in accordance with the present invention.
Figure 6:
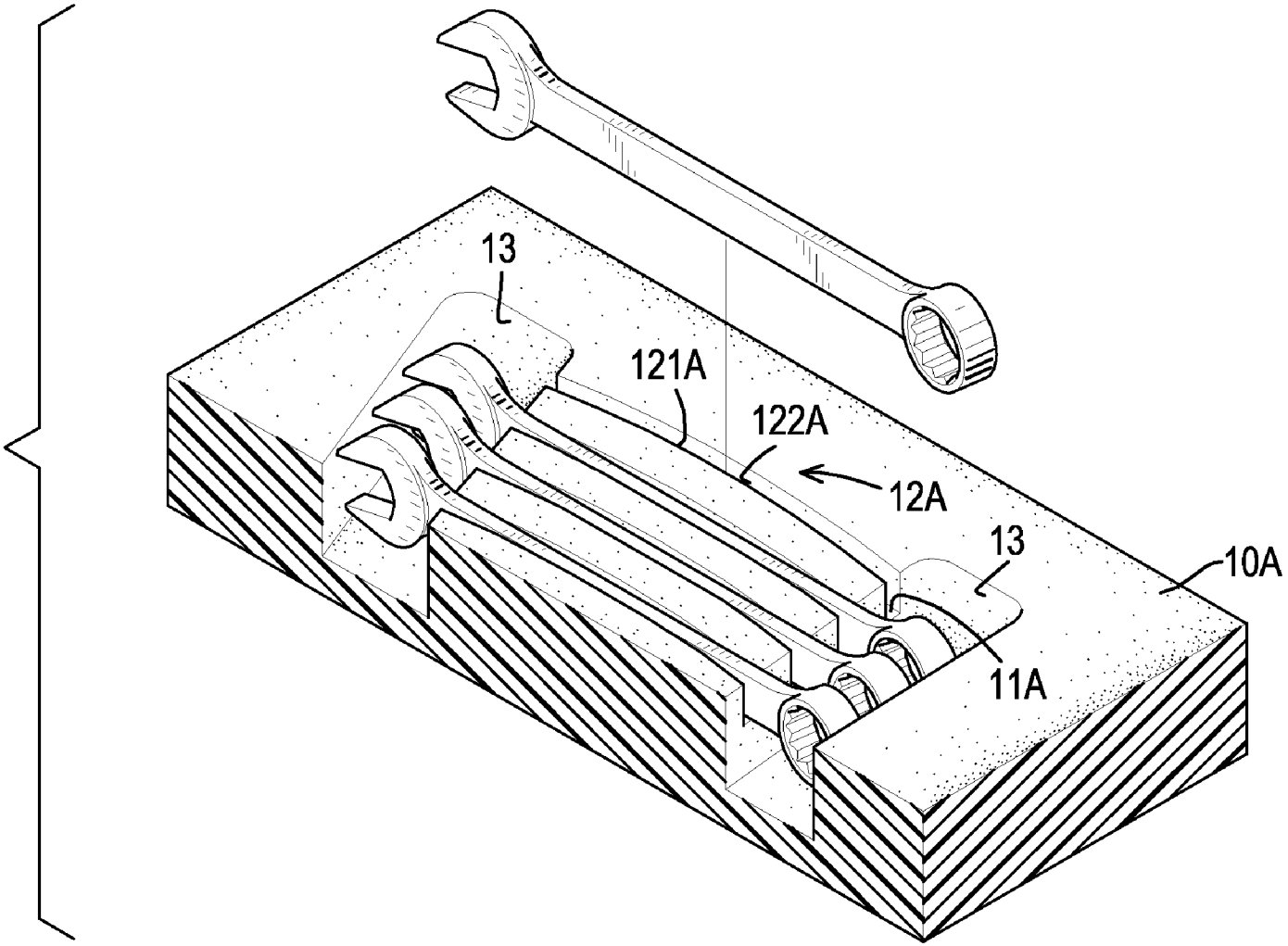
FIG. 6 is an operational perspective view in partial section of the tool positioning pad in FIG. 5, showing that spanners are independently mounted in the positioning slots.

In a second embodiment in accordance with the present invention shown in FIGS. 5 and 6, the tool positioning pad comprises multiple positioning slots (11A) being parallelly formed therein. Each one of the positioning slots (11A) is an arced slot to form the non-straight section (12A). As described as the preferred embodiment of the present invention, the tool will also be pressed by the convex inner sidewall (121A).

Figure 7:
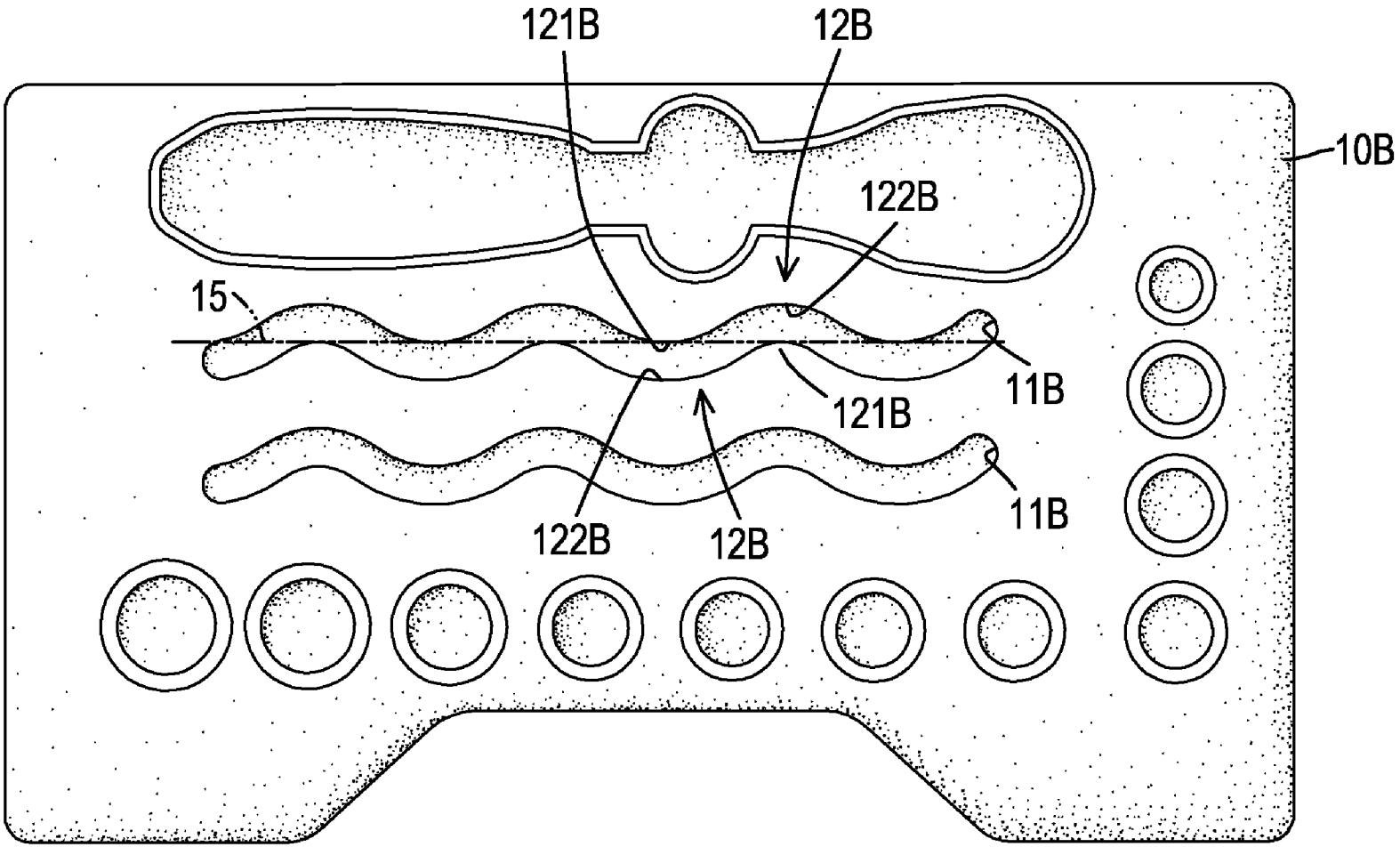
FIG. 7 is a top view of a tool positioning pad comprising multiple wavy positioning slots in accordance with the present invention.
Figure 8:
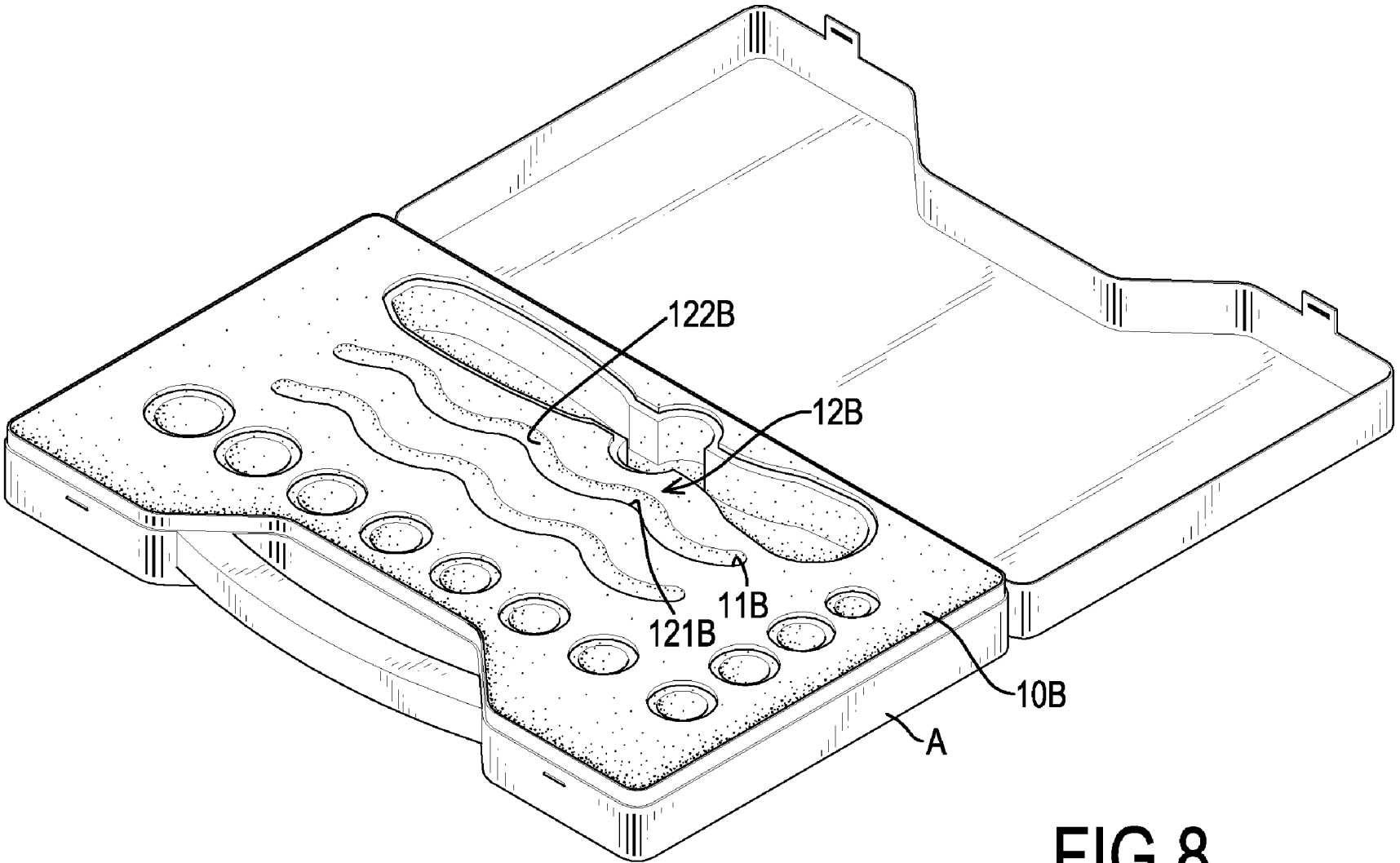
FIG. 8 is an operational perspective view of the tool positioning pad in FIG. 7, showing the tool positioning pad being placed inside a tool box.
Figure 9:
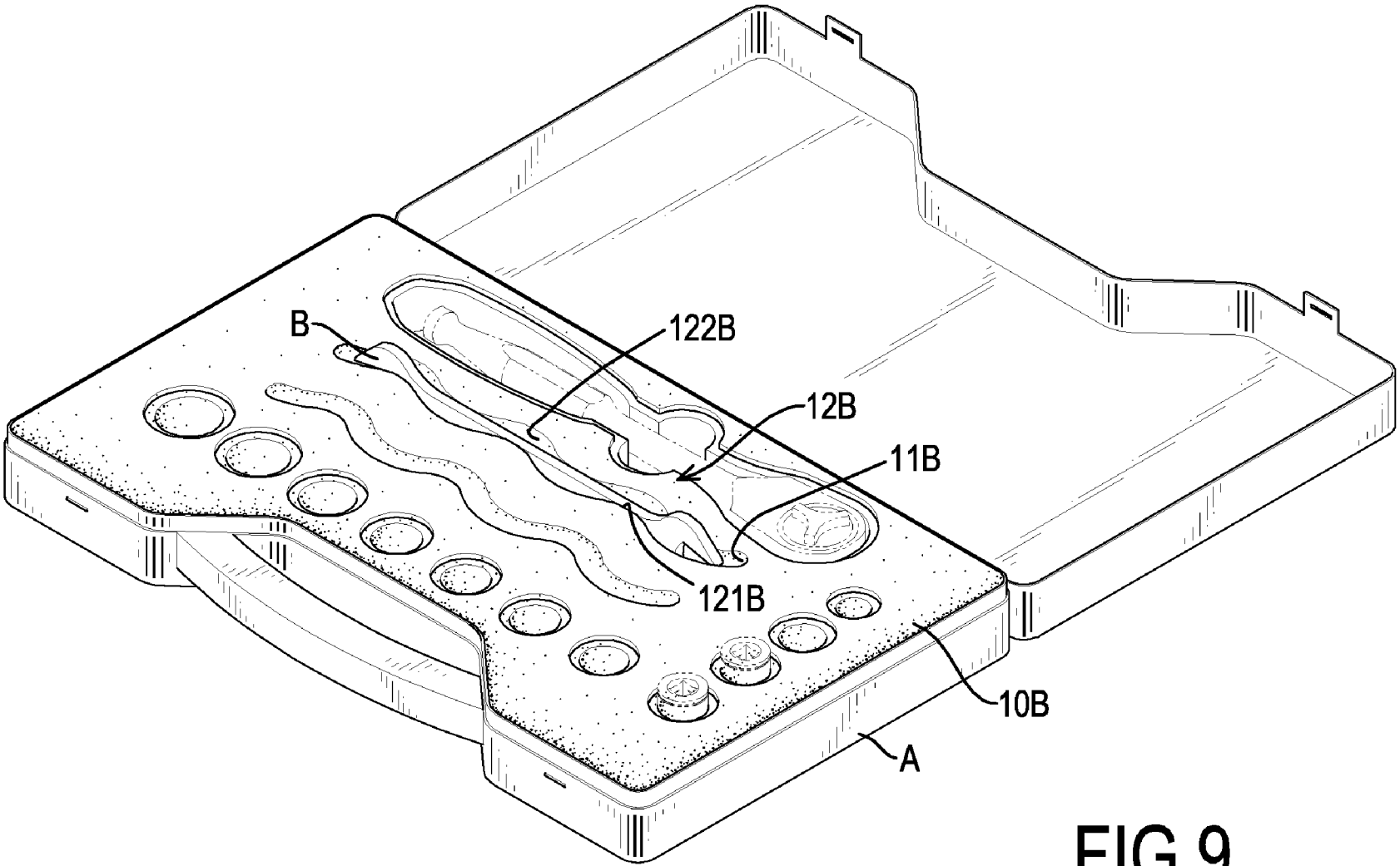
FIG. 9 is an operational perspective view of the tool positioning pad in FIG. 8, showing a spanner is mounted in one wavy positioning slot.

In a third embodiment in accordance with the present invention shown in FIGS. 7-9, the positioning slot (11B) is formed as a wavy slot and comprises multiple non-straight sections (12B). The non-straight sections (12B) are serially and longitudinally connected to form the positioning slot (11B).

Figure 10:
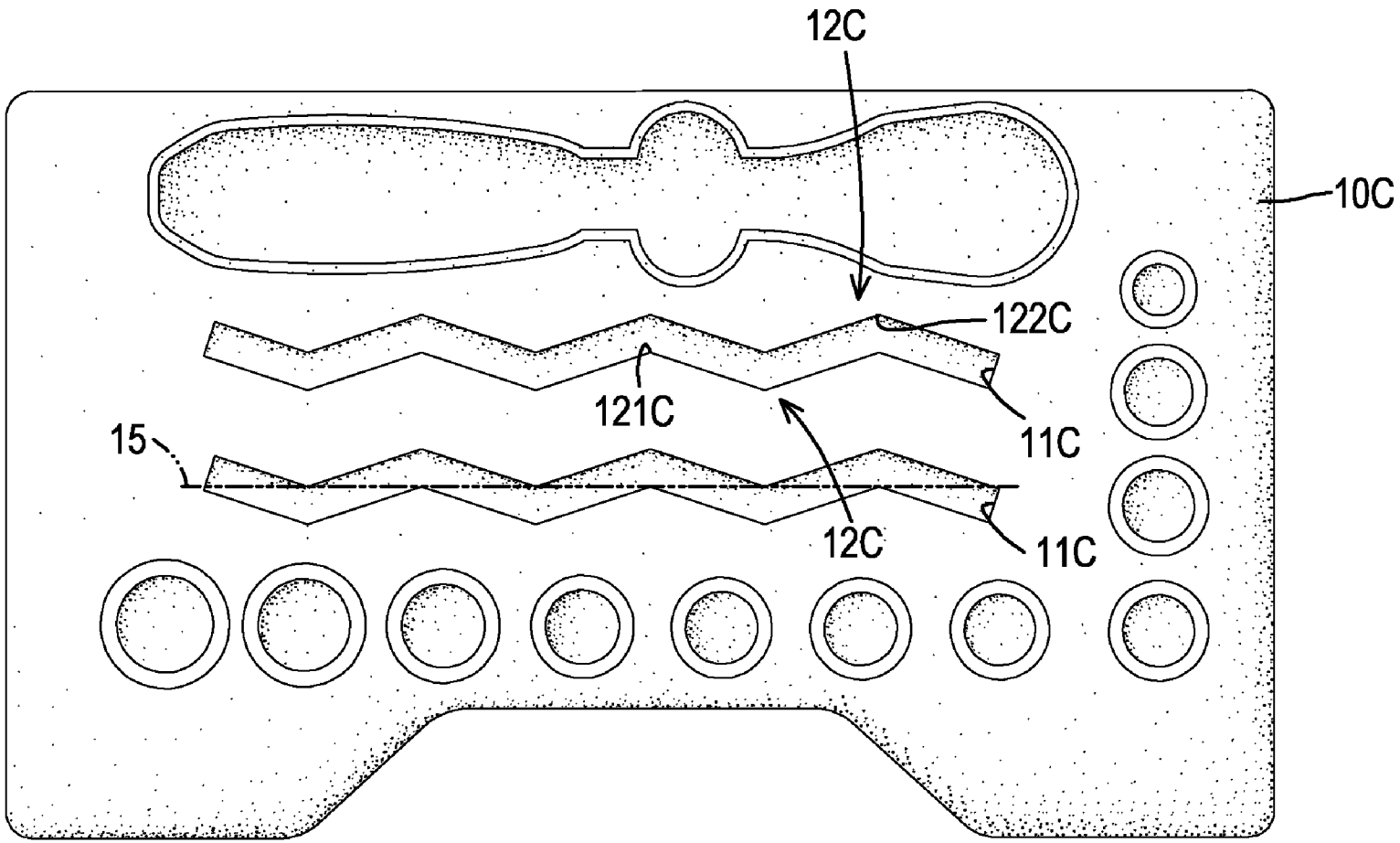
FIG. 10 is a top view of a tool positioning pad comprising multiple zigzag positioning slots in accordance with the present invention.

In a forth embodiment of the present invention shown in FIG. 10, the positioning slot (11C) is formed as a zigzag slot and comprises multiple non-straight sections (12C). Each non-straight section (12C) is V-shaped. The non-straight sections (12C) are serially and longitudinally connected to each other to form the positioning slot (11C).

As described above, a very thin tool such as a ruler, a saw or a spanner may be placed in the positioning slot (11, 11A, 11B, 11C) and is capable of mounted securely in the positioning slot (11, 11A, 11B, 11C) since the convex inner sidewall (121, 121A, 121B, 121C) is deformed to clamp the tool securely. Therefore, a positioning slot (11, 11A, 11B, 11C) can be applied to hold tools with different sizes, forming the positioning slot (11, 11A, 11B, 11C) may also become very easy because knifes for forming positioning slots with different sizes as a conventional tools positioning pad are no more needed.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A tool positioning pad comprising
- a body being a plastic foam block and having two long sides and two short sides; and
- a positioning slot being formed in the body and the positioning slot having
  - two ends; and
  - at least one non-straight section being integrally interconnected longitudinally in the positioning slot, each one of the at least one non-straight section having
    - a convex inner sidewall having
      - at least one clamping point being defined on the convex inner sidewall to press against a flat tool; and
      - a tangent line linking with the at least one clamping point, passing through the ends of the positioning slot and parallel with the long sides of the body; and
    - a concave inner sidewall facing and being parallel with the convex inner sidewall.

2. The tool positioning pad as claimed in claim 1, wherein the tool positioning pad further has two containing recesses being respectively formed in the body near the short sides and each containing recess being communicated with one of the ends of the positioning slot and the tangent line passes through the containing recesses of the tool positioning pad.

3. The tool positioning pad as claimed in claim 2, wherein the positioning slot is straight near the ends and includes one non-straight section centrally interconnected with the positioning slot between the ends.

4. The tool positioning pad as claimed in claim 2, wherein the positioning slot is an arced slot to form one non-straight section.

5. The tool positioning pad as claimed in claim 2, wherein the positioning slot is a wavy slot having multiple serially connected non-straight sections, each non-straight section is arced.

6. The tool positioning pad as claimed in claim 2, wherein
- the tool positioning pad has multiple positioning slots being parallelly formed in the body, the two ends of each positioning slot are respectively grouped on the short sides of the body; and
- each containing recess is communicated with one end of each positioning slot that is formed on the same short side of the body.

7. The tool positioning pad as claimed in claim 6, wherein each positioning slot is a straight section near the ends and includes a non-straight section centrally interconnected with the positioning slot between the ends.

8. The tool positioning pad as claimed in claim 6, wherein each positioning slot is an arced slot to form one non-straight section.

9. The tool positioning pad as claimed in claim 6, wherein each positioning slot is a wavy slot having multiple serially connected non-straight sections, each non-straight section is arced.

10. The tool positioning pad as claimed in claim 1, wherein the positioning slot is straight near the ends and includes one non-straight section centrally interconnected with the positioning slot between the ends.

11. The tool positioning pad as claimed in claim 1, wherein the positioning slot is an arced slot to form one non-straight section.

12. The tool positioning pad as claimed in claim 1, wherein the positioning slot is a wavy slot having multiple serially connected non-straight sections, each non-straight section is arced.

* * * * *